United States Patent [19]

Mohaupt

[11] 4,123,975

[45] Nov. 7, 1978

[54] PENETRATING PROJECTILE SYSTEM AND APPARATUS

[76] Inventor: Henry H. Mohaupt, 1151 Estrella Dr., Santa Barbara, Calif. 93110

[21] Appl. No.: 821,465

[22] Filed: Aug. 3, 1977

Related U.S. Application Data

[63] Continuation-in-part of Ser. No. 663,432, Mar. 3, 1976, abandoned.

[51] Int. Cl.[2] ..... F42B 11/02

[52] U.S. Cl. ..... 102/92.4; 102/DIG. 7; 102/38 MM; 175/2

[58] Field of Search ..... 102/38 R, 40, 52, 92.2, 102/92.3, 92.4, DIG. 7, 70 F, 60, 93, 49.7, 92.1; 89/1 C, 14 D; 299/13; 175/2

[56] References Cited

U.S. PATENT DOCUMENTS

| | | | |
|---|---|---|---|
| 2,449,571 | 9/1948 | Walker | 89/14 D |
| 3,302,570 | 2/1967 | Marguardt | 102/52 |
| 3,344,711 | 10/1967 | Mawhinney et al. | 102/92.4 X |
| 3,370,535 | 2/1968 | L'Permutter | 102/52 |
| 3,412,681 | 11/1968 | Schirneker | 102/38 |
| 3,434,425 | 3/1969 | Critcher | 102/92.1 |
| 3,450,050 | 6/1969 | Robinson | 102/92.4 |
| 3,476,048 | 11/1969 | Barr et al. | 102/38 |
| 3,498,222 | 3/1970 | Birkigt | 102/52 |
| 3,515,072 | 6/1970 | Barr | 102/DIG. 7 X |
| 3,680,485 | 8/1972 | Zaid et al. | 102/92.4 |
| 3,714,900 | 2/1973 | Feldmann | 102/52 |
| 3,745,926 | 7/1973 | Mertz et al. | 102/DIG. 7 X |
| 3,880,083 | 4/1975 | Wasserman et al. | 102/92.4 |
| 3,902,424 | 9/1975 | Dietsch et al. | 102/DIG. 7 X |

FOREIGN PATENT DOCUMENTS

| | | | |
|---|---|---|---|
| 663,288 | 8/1938 | Fed. Rep. of Germany | 102/38 |
| 665,970 | 10/1938 | Fed. Rep. of Germany | 102/49 |

*Primary Examiner*—David H. Brown

[57] ABSTRACT

A projectile having a length to diameter ratio greater than 6 to 1 is propelled from a launcher by a propellant charge toward a rock target at velocities of 500 ft./sec. and higher to more efficiently penetrate the rock for excavation purposes.

8 Claims, 24 Drawing Figures

10
12
14
16
18
20
22
24
26
28
30
32
34
36
38
40
42
12a
36a
38a
40a
42a
12b
36b
38b
40b
42b
44
12c
36c
38c
40c
42c
46
48

10d
50d
52d
56d
54d
10e
50e
58e
52e
56e
54e
10f
50f
66f
52f
64f
62f
60f
56f
54f
10g
50g
68g
52g
56g
54g
10h
50h
72h
70h
52h
54h 24
18
10i
70i
52i
77
72
75

10
12
18
85
84
78
82
80
76
24

12
24
90
88
86
18
92

12
18
20
22
34
108
110
112
114
116
118
120
122
124
126
86
88
92
94
96
128
130
132
133
134
136
138
40
142
144
18a
18b

PENETRATING PROJECTILE SYSTEM AND APPARATUS

CROSS REFERENCES TO RELATED APPLICATION

This application is a Continuation-In-Part of application Ser. No. 663,432, filed Mar. 3, 1976 by the same inventor now abandoned.

BACKGROUND OF THE INVENTION

This invention relates generally to methods and apparatus for excavating and in particular to methods and apparatus for penetrating rock and fracturing it by side thrust tensile forces.

Prior art devices for rapid drilling of holes in the ground or fracturing rock formations, in most cases by a crushing action, have consisted essentially of low velocity projectiles using shaped explosive charges, or explosive filled shells that were driven into the ground by propelling them from a gun. Some prior art devices utilizes a large mass projectile propelled from a gun at hypervelocities of 1.5 Km/sec. (4922 ft/sec.) and above. These high mass — high velocity devices are used primarily to crush the rock material rather than penetrate it.

Projectiles using shaped explosive charges or explosive filled shells propelled from a gun operated satisfactorily in relatively soft material such as sand, loam, clay and similar material, however, they have not proved satisfactory for excavation or penetration of rock, in particular, the igneous rocks such as granite, diarite and basalt, or the metamorphic rocks such as the gneisses, marble, slate and coal, or the hard sedimentary rocks such as limestone.

For excavation of such hard rock materials, high mass nonpenetrating, hypervelocity projectiles have been used, projectiles having velocities greater than 1.5 Km/sec. (4922 ft/sec.). To reach such high velocity for such high masses, guns of special design are required which can withstand extremely high breach pressures and require special safety precautions for their operation. Such devices fail to efficiently fracture rock by compressional impacts at lower velocities because of the great waste of kinetic energy in the process of compression, deformation and shock wave transmission.

SUMMARY OF THE INVENTION

The apparatus and process of the present invention utilizes projectiles which are of relatively low mass accelerated to velocities of 500 ft./sec. and above and having a high (6 to 1) length to diameter ratio, which, applicant has discovered, produces an increased efficiency in the utilization of available energy by way of penetrating deep into the rock to achieve side thrust toward a free face, in contrast to the prior art devices and methods to fracture rocks utilizing a crushing or heavy blow technique analogous to a sledge hammer. Within the concept of the present invention and the definition of the term projectile is both a laterally and longitudinally sectionalized projectile which is accelerated from the means for propelling the projectile as a single projectile unit but as transformed in flight to a plurality of projectiles following a predetermined trajectory and arrival time at the target.

It is, therefore, an object of the present invention to provide a device and method for fracturing rock.

It is a further object of the present invention to provide a device and method of fracturing rock using a projectile accelerated to velocities of 500 ft/sec. and above.

It is another object of the present invention to provide a device and method of fracturing rock using a projectile having a high length to diameter ratio.

It is still a further object of the present invention to provide a device and method of fracturing rock using a plurality of projectiles simultaneously accelerated to a velocity of 500 ft/sec. and above and representing a projectile unit having a length to diameter ratio greater than 6 to 1.

These and other objects of the present invention will become manifest upon study of the following detailed description when taken together with the drawings.

Figures 1, 2, 3, 4, 5:
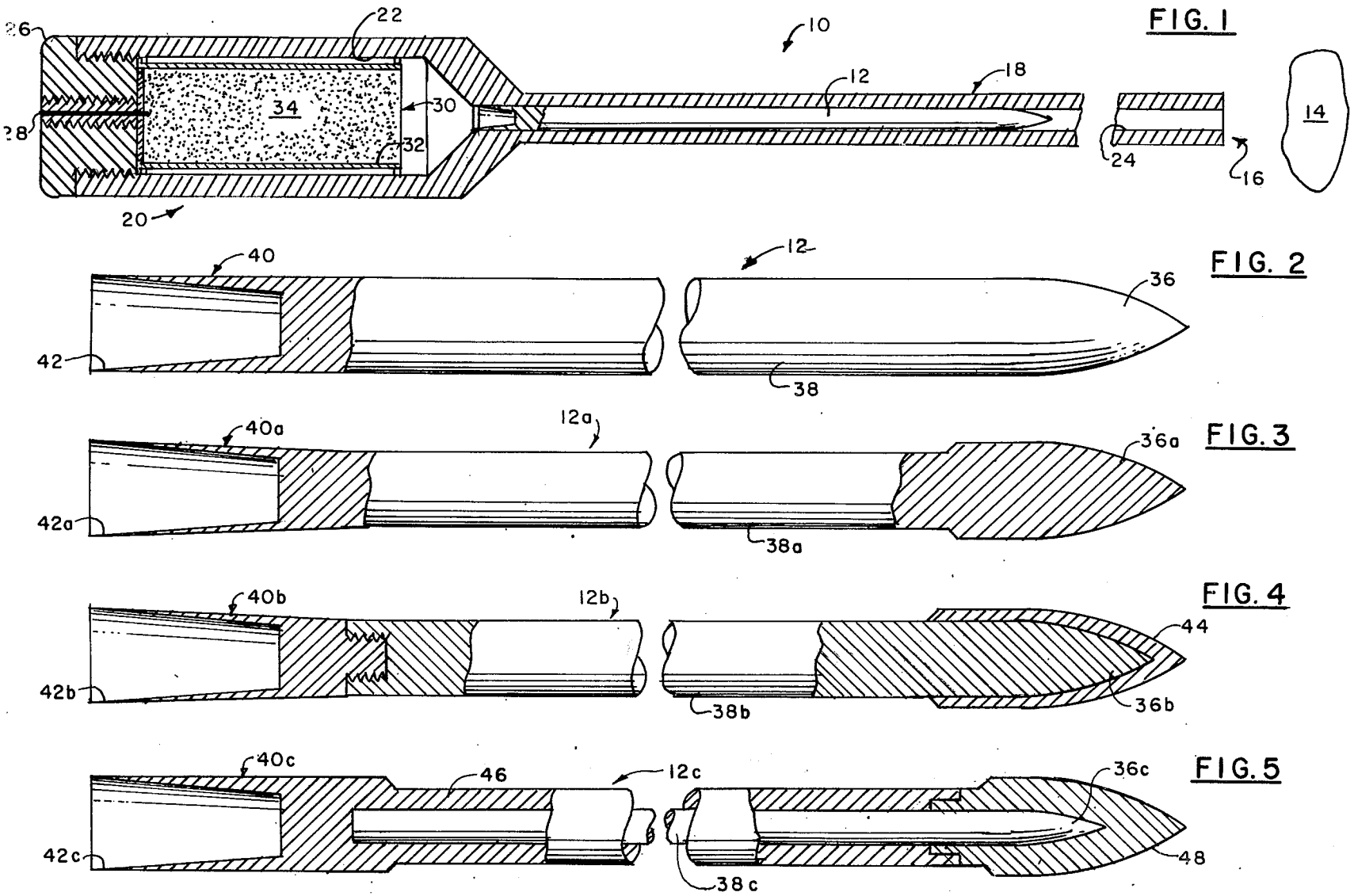
FIG. 1 is a longitudinal sectional view of a typical projectile disposed in a projectile launcher.
FIG. 2 is a longitudinal partial sectional view of a simple projectile for use in the device and method of the present invention.
FIGS. 3–4 are longitudinal partial sectional view of a typical projectile for use in the device and method of the present invention adapted to compensate for irregular curvature of the launcher barrel.
FIG. 5 is a longitudinal partial sectional view of a typical projectile for use in the device and method of the present invention having a very high length to diameter ratio.

FIGS. **19–19*a* are longitudinal sectional views taken at the muzzle of the launcher of FIG. 1** showing a method of capturing the gaseous byproducts from the propelling charge.

Figure 20:
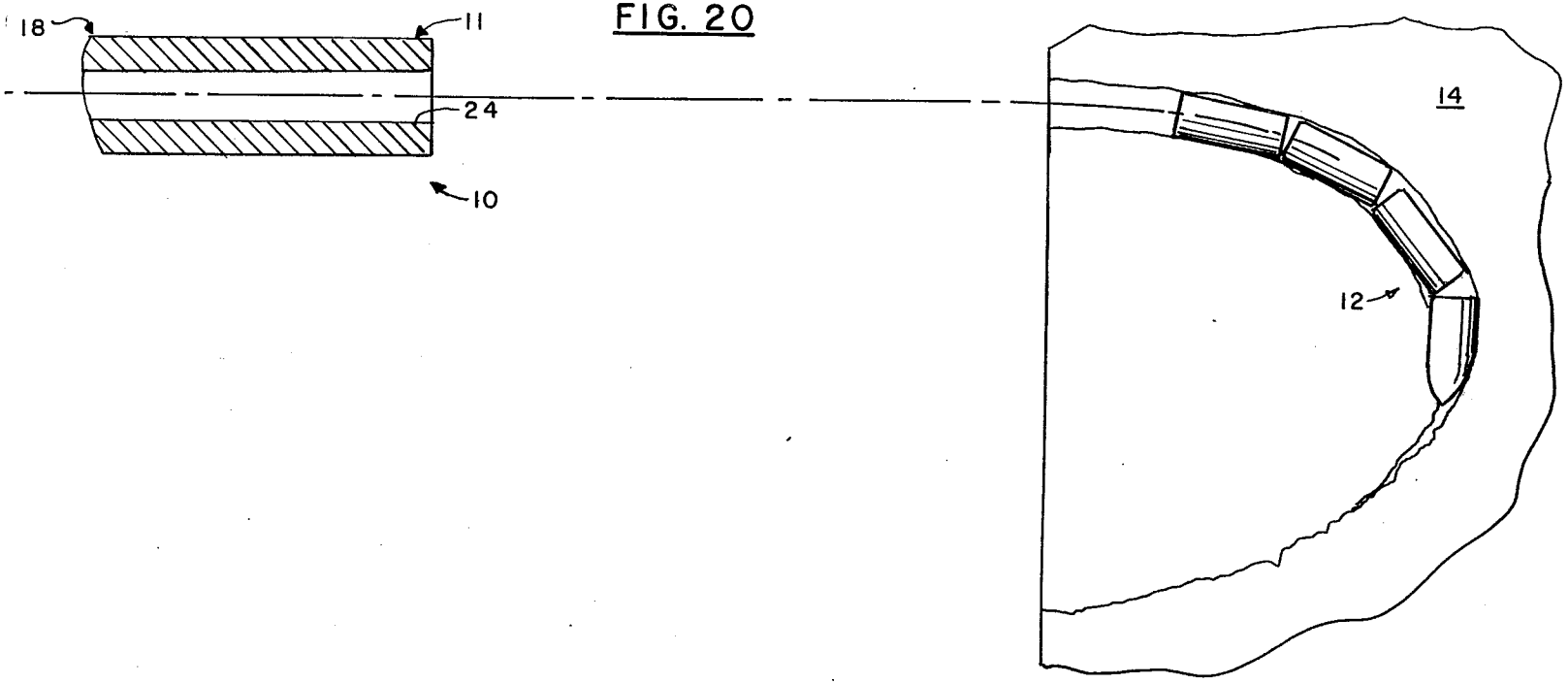

FIG. 20 is an illustration of a projectile having an asymmetric nose for producing curved paths within the rock target.

DESCRIPTION OF THE PREFERRED EMBODIMENT

With respect to FIG. 1, there is illustrated a longitudinal sectional view of a typical projectile propelling device or launcher 10 used for accelerating a projectile 12 toward a rock target 14.

Launcher 10 comprises, basically, a muzzle section 16, a barrel section 18 and a breech section 20. In the embodiment illustrated in FIG. 1, breech section 20 comprises a propellant chamber 22 having a diameter larger than the bore 24 of launcher barrel 18. Access to chamber 22 to obtained by threaded breech plug 26 in which is disposed an ignition plug 28.

It must be particularly noted that launcher 10 is more correctly referred to as a "tool" rather than a "gun" for several reasons. First, the distance of the muzzle of launcher 10 from a rock face is typically 30 feet or less in contrast to ranges of 500 ft. or more for weapons. Second, there is no rifling in the bore to attempt to spin stabilize the projectile in contemplation of a long trajectory. The bore is, therefore, smooth. Also, because of the large length to diameter (L/D) ratio of the projectile, spin stabilizing is not practical nor desired in the present invention.

Propelling charge 30 can be of varying configurations, the one illustrated in FIG. 1 comprises a charge case 32 enclosing propellent charge 34.

Typical projectile 12 is shown in FIG. 2 and comprises a nose or head section 36, an elongated, generally cylindrical body section 38 and a trailing or tail section 40. Tail section 40 comprises gas obturator 42 which is adapted to prevent the escape of propelling gases past projectile 12 down bore 24 of barrel 18, thus increasing the efficiency of operation.

The high L/D projectile system requires bores of considerable length to take advantage of sustained acceleration. These long bores (barrels) are somewhat flexible due to wall thickness limitations dictated by economic and weight considerations. In practical applications there is, therefore, no assurance that the bore will be in a straight line as the long projectile passes through.

In certain penetration applications, projectiles of great hardness and consequently brittleness are required which will not negotiate any curvature in the bore without breakage.

The projectiles illustrated in FIGS. 3 through 11 are adapted to adjust to any curvature of barrel 18 while being accelerated therethrough.

With respect to FIG. 3, projectile **12*a* comprises a nose section 36*a* and an obturator portion 42*a* having an outside diameter greater than the diameter of body portion 38*a* yet adapted to fit in bore 24 of launcher 10. Thus the major portion of body portion 38*a* will be out of contact with bore 24** which permits negotiation of modest irregularities in the straightness of the bore.

With reference to FIG. 4, projectile **12*b* comprises a nose section 36*b* encased in a light weight, ductile sleeve 44. Both sleeve 44 and obturator 42*b* are arranged with an outside diameter greater than body portion 38*b* yet adapted to fit in bore 24 of launcher 10**.

It should also be noted that gas obturator 42 can be an integral part of projectile 12, as in FIGS. 2 and 3 or, a separate and detachable unit as shown in FIG. 4.

With reference to FIG. 5, core body **38*c* of projectile 12*c* is shown encased in a light weight, ductile body sleeve section or portion 46 with nose section or portion 36*c* encased in a light weight, ductile nose cap 48. Nose cap 48 and obturator 42*c* are arranged with their outside diameters greater than core body sleeve 46 yet adapted to fit into bore 24 of gun 10**.

The projectile configuration of FIG. 5 permits the acceleration of very high length to diameter (L/D) ratio projectiles without buckling failure of the projectile through high compressive columnar loading.

Figure 5A:
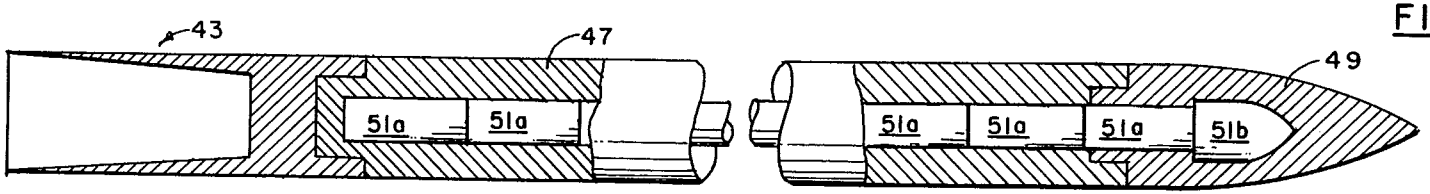
FIG. 5A is a longitudinal partial sectional view of a typical projectile for use in the apparatus and method of the present invention showing the use of a plurality of core body projectile members encased in a ductile sleeve.

With reference to FIG. 5A, a projectile configuration similar to FIG. 5 is shown, however, core body 38c is replaced by a plurality of individual, serially disposed core body members **51*a* and a core body nose portion 51*b* encased in a ductile, sleeve 47. Nose cap 48 of FIG. 5 is replaced, in FIG. 5A, by a ductile nose cap section 49. Obturator portion 43 of FIG. 5A is, in all respects, similar to obturator portion 40*c* of FIG. 5**.

Figure 5B:
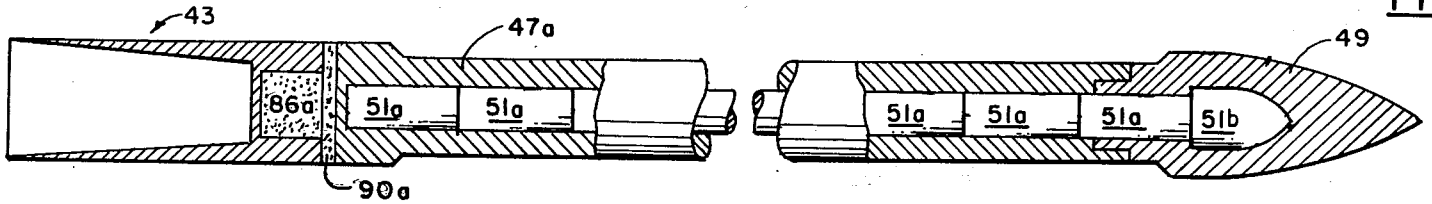
FIG. 5B is a longitudinal partial sectional view of a typical projectile for use in the apparatus and method of the present invention showing the use of a frictionally ignitable material to ignite a propellant.

Although nose cap 49, body sleeve 47 and obturator portion 43 are all shown in FIG. 5A to have the same outside diameter that is equal to the inside diameter of bore 24 (FIG. 1), body sleeve 47 could also be of a smaller diameter than nose section 49 and obturator section 43 as shown in FIG. 5B for body sleeve **47*a*, in order to reduce internal friction due to irregularities in bore 24**.

Figures 6, 7, 8, 9, 10:
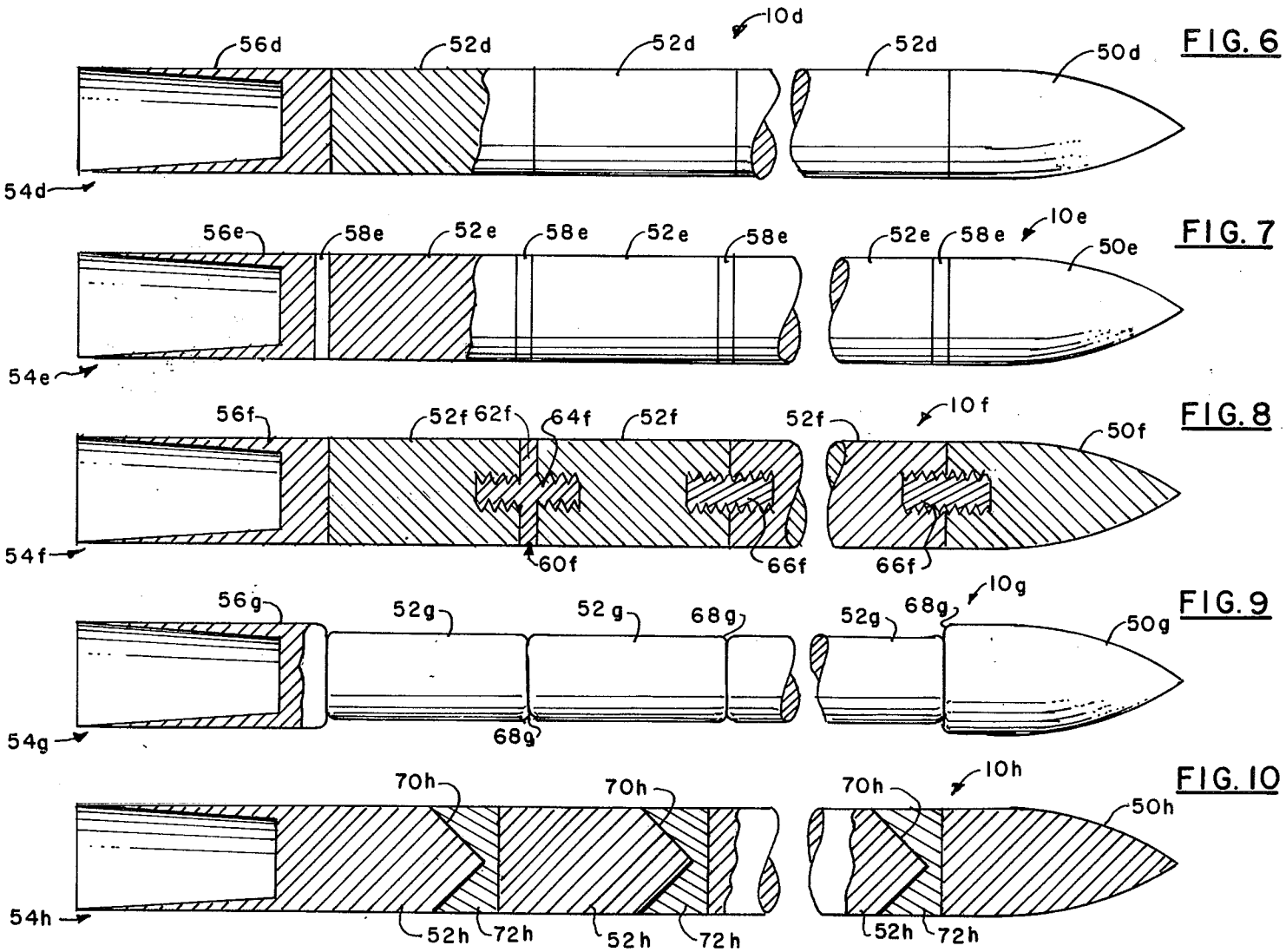
FIGS. 6–11 are longitudinal partial sectional views of typical multiple section projectiles for use in the device and method of the present invention which are accelerated simultaneously from the projectile launcher.

The configuration of projectile **51*a* can also be arranged to be similar to the multiple projectile 52*e*, 52*f*, 52*g* and 52*h* configuration in FIGS. 7, 8 and 9**, respectively.

Whereas core body **38*c* and core body members 51*a* and 51*b* comprise a relatively hard material having a hardness of not less than 59 Rockwell C, sleeve portions 46 and 47, along with nose caps 48 and 49, are fabricated from a more ductile material, such as aluminum or even mild ductile steel of other material which has sufficient durability to withstand the launching temperatures and sufficient strength to keep core body 38*c* and core bodies 51*a* from collapsing due to compressive columnar loads during launching and also keep core body members 51*a* in alignment until they reach the rock face target 14 (FIGS. 1 and 20**).

It will also be noted in FIGS. 5A and 5B that core body sleeve nose portion or projectile **51*b* is of a larger diameter than core body members 51*a***. This particular configuration is used to increase the efficiency of rock penetration by providing an enlarged entry hole through which the smaller diameter projectile body or core portion passes to impart the major portion of its kinetic energy to fracture the rock target, rather than lose energy through frictional contact with the sides of the entry hole. Although the front projectile may waste energy by being ground down though frictional contact with the sides of the hole, the remaining projectiles that follow will not be subjected to such wasted energy.

An additional advantage of the use of sectionalized core body members **51*a* and 51*b*** formed into a projectile unit is that if a fracture occurs in one of the core body members, it will not be transmitted to the other core body members so that projectile reliability is increased.

In FIG. 6, projectile **10*d* is shown laterally subdivided into a leading or nose section or cap 50*d*, a plurality of serially disposed generally cylindrical core body members 52*d*, terminating at the trailing or tail end 54*d* with obturator section 56*d***.

With reference to FIG. 7, a mild steel disc **58*c* is provided to cushion the uneven stresses which may build up through contact between hard surfaces of the serially disposed core body members 52*e*. These mild steel discs must have sufficient strength to withstand the compressive stress ocurring during acceleration of the columnar projectile unit within launcher barrel 10**.

In FIG. 8, two other connector types are illustrated. Connector 60*f* comprises a disc plate 62*f* and a threaded portion 64*f* adapted to engage a like threaded portion in each core body section 52*f*. Connector 66*f* is similar to connector 60*f* but without disc portions 62*f*.

FIG. 9 is an illustration of the use of a core body member 52*g* having curved edges 68*g* at their leading and trailing edges.

With respect to FIG. 10, there is illustrated the use of separate core body sections 52*h* each having a shaped nose or leading end 70*h* with each section 52*h* connected to each other by a nose element protector 72*h*.

Figures 11, 12, 13:
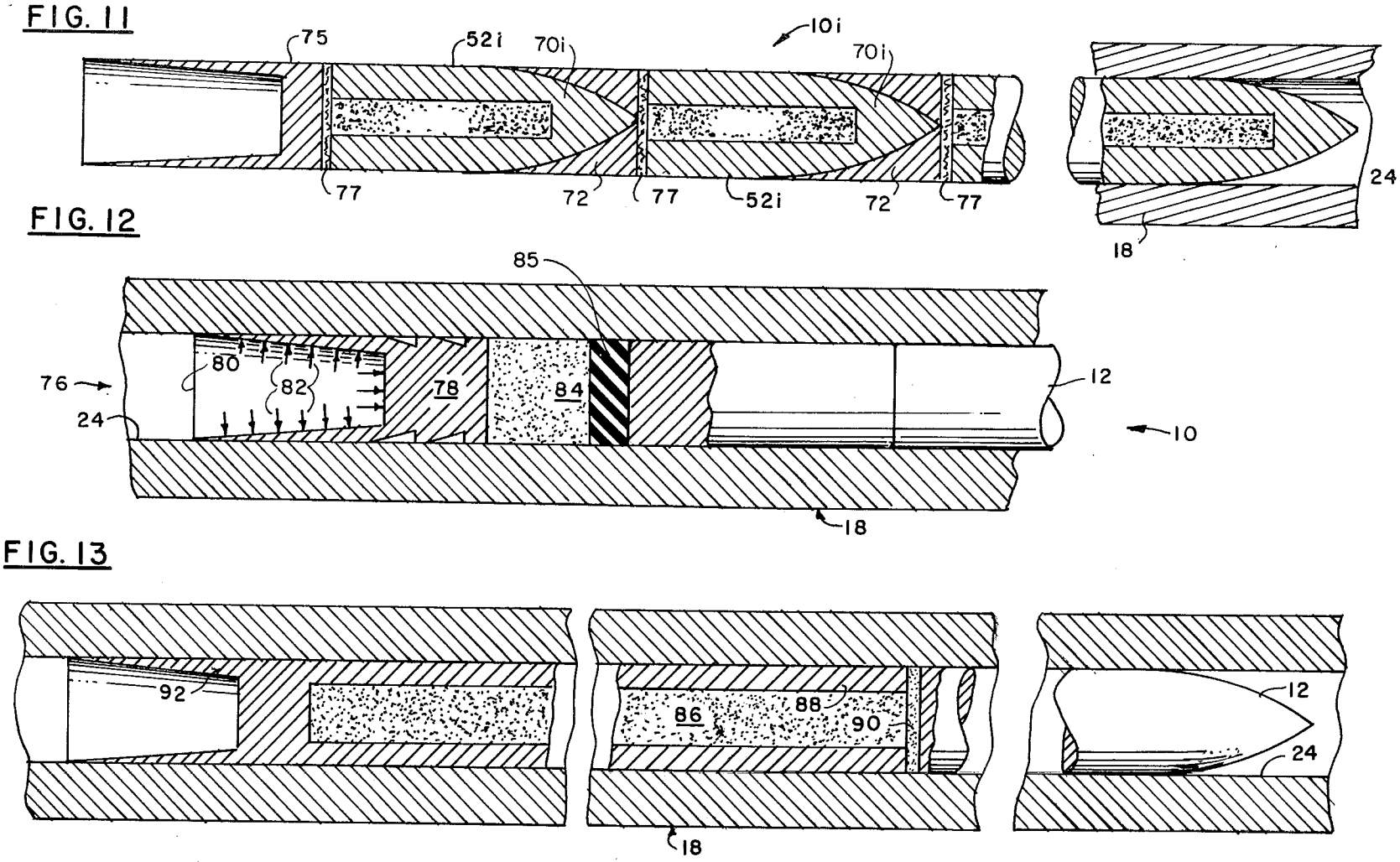
FIG. 12 is a longitudinal sectional view of the trailing end of a typical projectile of the present invention.
FIGS. 13 and 13a are longitudinal sectional views of another embodiment of a typical projectile of the present invention.

With reference to FIG. 11, there is illustrated a projectile configuration similar to that of FIG. 10, however, body section 52*i* is arranged to be hollow and contain a generally cylindrical propellant booster charge 74.

In FIG. 11 the main propellant charge 74 exerts its gas pressure against obturator 75 and transmitts thrust to the entire column causing its forward movement. The hollow projectile 52*i* has its nose section 70*i* embedded into protector 72 which may also serve as a gas check. The sequence may be repeated with a plurality of projectiles. As the column is accelerated through the bore, the friction or impact sensitive mixture 77 positioned at the base of the projectile flashes and ignites the propellant charge 74, provided in hollow projectile 52*i*.

FIG. 12 shows detail of an obturator assembly 76 which includes a mild steel body member 78 terminating in a thin section or lip 80 which is capable of expanding under influence of the gas pressure as shown by arrows 82 to closely conform to the inside diameter of bore 24 and to adjust to oversize or eroded sections in bore 24 and provide a gas seal, operational while in motion in the bore. Additionally a rubber seal 85 may be used between obturator assembly 76 and projectile 12 which remains compressed while pressure is exerted against it either by obturator 76 or by gas leaking by, in case of failure or partial failure of the obturator. Obturator 76 can be made from mild steel, a material which does have sufficient elasticity to expand when needed and of sufficiently high melting point to withstand the heating caused by friction in the bore. The adaptability of this type obturator to varying bore diameters permits the use of bores with large tolerances and economical construction.

In FIG. 13 a large propellant booster charge 86 is accommodated in the rear of projectile 12 and contained in propellant holder shell 88.

A friction or delay ignitor 90 is provided at the leading or front end of propellant holder shell 88 and the trailing end of projectile 12. Propellant holder shell 88 is provided, at its trailing end, with an obturator 92 to prevent gas leakage when propelled by gases from breech 20 (not shown in FIG. 13).

Figures 13A, 15, 16, 17, 18:
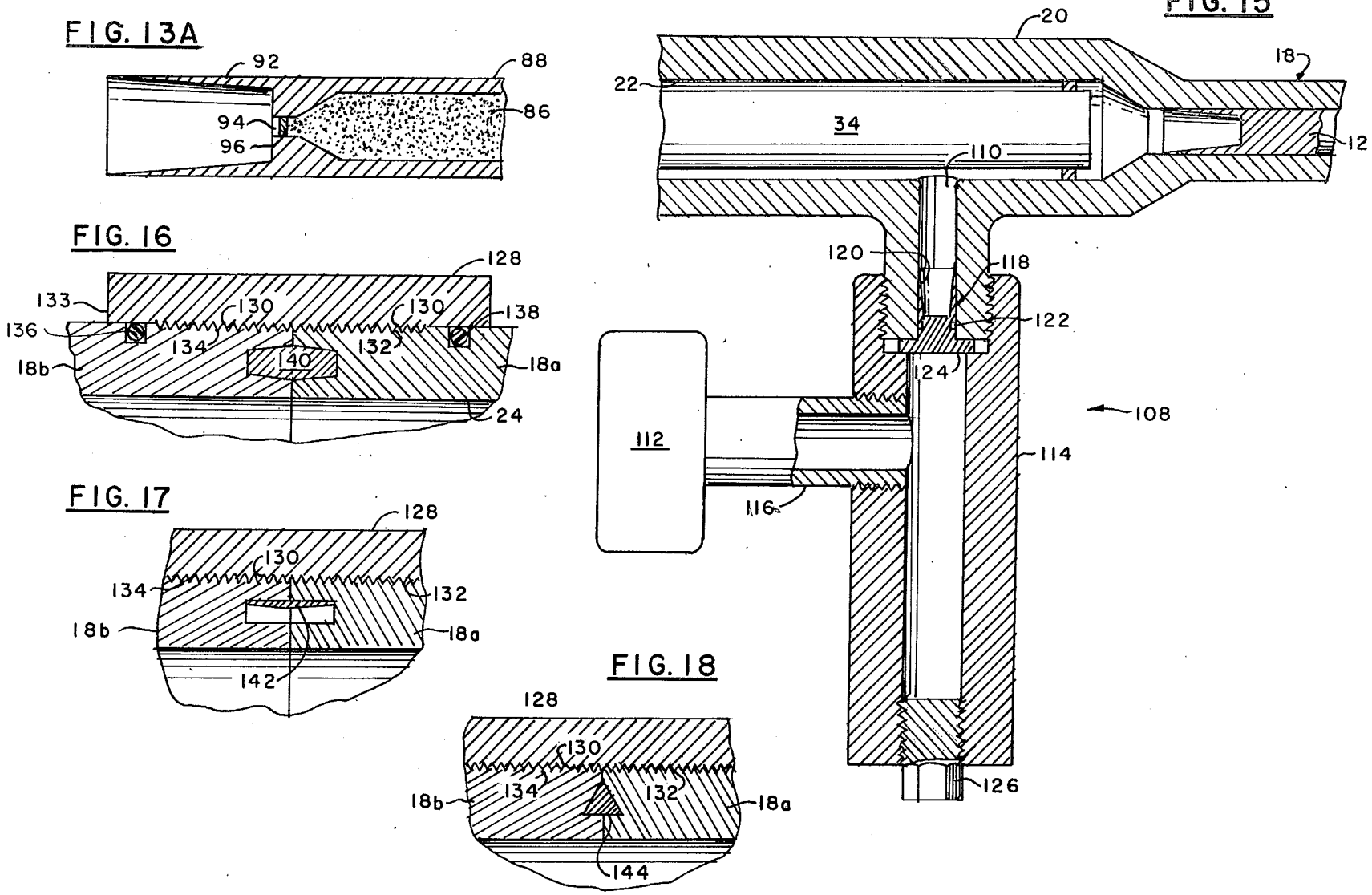
FIG. 15 is a longitudinal sectional view of a safety device to protect against dangerously high breech pressures.
FIGS. 16–18 are longitudinal partial sectional views of various methods for extending the length of the barrel of the projectile launcher.

In FIG. 13*a*, obturator 92 is provided with bulkhead heat conductor 94 which is adapted to conduct the head from the main propellant charge 34 (see FIG. 1. Not shown in FIG. 13*a*) to raise the temperature of heat sensitive material 96 to ignition temperature and thus ignite propellant booster charge 86.

Figure 14:
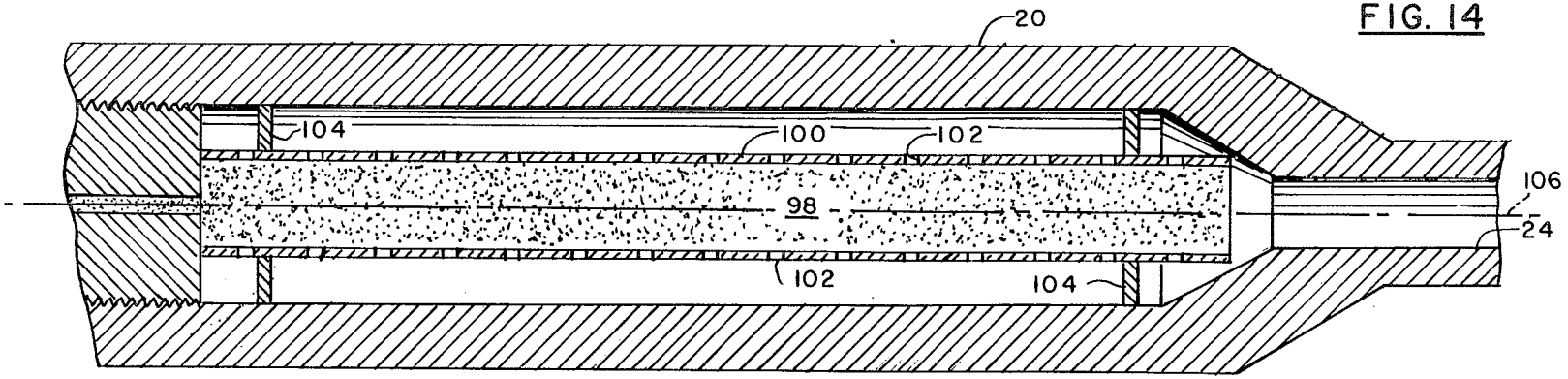
FIG. 14 is a longitudinal sectional view of a propelling charge disposed in the breech of the launcher used for propelling the projectile of FIGS. 2 through 11.

With reference to FIG. 14, there is illustrated another embodiment of a primary propellant charge configuration contained in breech 20 comprising a primary propellant charge 98 disposed in a generally cylindrical containment sleeve 100 having a plurality of perforations 102 therein. Containment sleeve 100 can be fabricated from any consumable material such as cardboard. Several spacer pins or discs 104 are provided at several points along the length of sleeve 100 in order to maintain the longitudinal axis of sleeve 100 and charge 98 coincident with the longitudinal axis 106 of breech 20 and launcher 10.

In some instances, projectile 12 may get jammed or be delayed in its travel down bore 18 causing excessively high breech pressures to develop in breech 20. FIG. 15 illustrates a method whereby such pressures may be released by use of over-pressure relief assembly 108.

Over-pressure relief assembly 108 comprises, basically, a safety port 110 communicating the interior of breech chamber 22 with an expansion chamber 112 or to the atmosphere through first conduit 114 and second conduit or nipple 116.

A high pressure seal 118 is provided in safety port 110 comprising a gas obturator 120 disposed at the high pressure side and annular pressure seal 122 proximate the low pressure side and a shear flange 124 adapt to fail by shear failure at maximum designed breech pressure. A safety plug 126 is provided at the end of first conduit 114 opposite high pressure seal 118 in order to retain it after it has been sheared and discharged from port 110 upon the occurance of an over-pressure in chamber 22.

Since barrel 18 of projectile launcher 10 must be long in order to accommodate the high L/D projectile 12 used in the method of excavation of the present invention, FIGS. 16–18 illustrate several ways for extending barrel 18 by sections. Basically, they comprise a coupler 128 having internal threads 130 which are adapted to engage like external threads 132 and 134 proximate the butting ends of barrel sections 18*a* and 18*b*. An O-ring seal 136 and 138 is provided to insure a gas tight connection.

Several types of alignment seals are shown in FIGS. 16–18. A tapered wedge alignment seal 140 is shown in FIG. 16 to seal the abutting ends of barrel 18*a* and 18*b*. In FIG. 17 a thin metal alignment seal 142 is used and in FIG. 18 there is illustrated the use of a triangular wedge ring seal 144.

OPERATION

Conversion of potential gas energy into kinetic energy of a solid projectile is most efficiently accomplished in what is classically known as a propellant chamber within launcher breech section 20 and bore 24 in which energy transfer takes place by acceleration of the projectile. The continued thrust on the projectile base is insured by the expansion of the gases which are usually generated by the combustion of solid propellants. The conversion of the solid propellant into gas is accompanied by the release fo large amounts of thermal energy resulting in high gas temperatures which contribute very significantly to pressure increase. Due to the high temperature differential between the gases and the chamber and bore, a portion of the energy available is drained into the surrounding device by thermal conductivity representing a loss in efficiency.

It has been customary to seek improvement in the performance of propulsion systems by increasing the ratio of propellant to projectile mass while operating at the highest permissible pressures to impart high velocity and kinetic energy to the projectile. The extent to which this can be carried out is subject to practical limitations as demonstrated by the following actual tests with increasing ratio of propellant to projectile:

| Ratio | Projectile velocity V ft./sec. | $V^2$ |
|---|---|---|
| 0.2 | 2600 | 6,750,000 |
| 0.3 | 3000 | 9,000,000 |
| 0.8 | 4200 | 17,600,000 |
| 3.2 | 6400 | 41,000,000 |
| 5.8 | 7400 | 54,800,000 |
| 11.0 | 8000 | 64,000,000 |
| 22.0 | 9000 | 81,000,000 |
| 44.0 | 9200 | 84,000,000 |

Where V = launch velocity in ft./sec.
$V^2$ = a figure proportional to projectile energy.

It is apparent that ratios considerably greater then 3 to 1 do not yield results commensurate with the amount of propellant required primarily because approximately 50% of the propellant mass itself must be accelerated in the bore.

Situations requiring kinetic energy beyond the practical capacity of a given system are obtained conventionally by an increase in bore diameter with a proportional scaling up of all other dimensions while remaining in the efficient range of low propellant to projectile ratios.

The practical effect of this is that penetrations in hard targets cannot exceed a certain value in terms of projectile diameter or caliber, namely approximately 4 calibers in steel or hard rock. It should be noted also that in the low impact velocity regimes, plastic deformation of the target is essentially limited to the penetrated region while high impact velocity in the range above 5000 ft-sec. produces impact pressures causing extensive plastic flow and cratering in the target and plastic flow of the projectile. These high velocity hydrodynamic penetrations can somewhat exceed the 4 caliber penetration depth mentioned above but they are achieved at the expense of very high pressures causing considerable erosion and cumulative bore damage.

Interior ballistic theory shows that in order to attain a high muzzle velocity at a given average pressure it is necessary to make the ratio m/V, (projectile mass m and bore volume V) small and the ratio C/m large where C is the mass of the propellant and m projectile mass. The fact that for a given average pressure the ratio of projectile mass $m$ to bore volume $V$ must be small can be seen from the following considerations: Since the muzzle energy is equal to the work done on the projectile we may write $$A\,P\,L = MV^2/2$$

where A is the crossectional area of the bore, $P$ is the mean effective pressure acting on the projectile base, $L$ is the length of the bore, $m$ is the effective projectile mass and $V$ is the muzzle velocity. This can be written as $$(2\,P/m/v) = V^2$$

where $V = AL$ and is the internal volume of the bore.

In theory it appears that high muzzle velocities may be imparted by increasing the length of bore while maintaining the same expansion ratio and means pressure. This holds true within a certain range but in practice, however, axial gas motion in long, small diameter bores is substantially impeded by friction losses, resulting in pressure decay at the head of the gas column, with consequent reduction in energy transferred to the projectile.

Deep penetration in steel, hard rock, etc. are dependent on maintaining an impact pressure at the interface of projectile nose and target, sufficient to cause radial compaction or plastic flow of the affected target area.

Progression of the projectile into the target, on the other hand is dependent on its kinetic energy being converted into work in the target area under attack and on the ability of the projectile to withstand the longitudinal compressive and lateral bending stresses without failure.

The penetrator projectile is designed to penetrate and deliver energy along its trajectory in the target through these forces associated with compression and plastic flow of the target material. Energy deposition at depth is an important feature of the penetrator since this internally deposited energy can cause rock to fracture toward any free face including the face associated with projectile impact. This energy associated with rock fracture by tension cracking toward a free face is very small when compared with the energy required for rock fracture compression techniques such as surface impact.

It is apparent that as the hardness or resistance of the target material is increased, the penetration process requires expenditure of increasing amounts of energy resulting in higher impact stresses and bending moments which ultimately may cause failure of the projectile. It is for these reasons that standard projectiles designed for penetration of hard targets have been held to an L/D ratio in the order of 4 or less for steel projectiles. Increases in cross sectional loading without change in L/D can be obtained by substituting expensive high density tungsten carbide for mild steel.

When considering the mechanics of penetration into rock of various physical properties it has been found that a minimum hardness of 59 Rockwell C of the projectile for the several combinations will permit retention of the suitable projectile shape during the penetration process.

PENETRATION

It has been discovered by applicant that most target materials show a marked increase in penetration depth as L/D ratios are increased beyond the long established conventional ratio of 1 to 1 or 3 to 1. It has been found that penetrations in steel armor at impact velocity of 5000 ft-sec. show a marked increase with increasing L/D ratio. At L/D = 30 penetration in 300 Brinell hardness is approximately 15 projectile diameters. At 370 Brinell hardness and L/D = 30 the penetration is reduced to 10 projectile diameters. This shows that in this velocity regime, when there is a transition to hydrodynamic penetration, target hardness still influences penetration depth.

The system of high L/D projectiles, combined with appropriately long bores, permits delivery of extremely high kinetic energy per unit area. However, unless some very important safeguards are taken, the high energies available are not translated into useful penetration.

It has been discovered by applicant that projectiles beyond the conventional L/D of about 4 to 1 become increasingly more sensitive to bending moments, side thrust and oblique impact with the target. In some applications it is imperative to limit the free flight of the projectile so as to preclude any yaw. In order to control this, the recoil of the propulsion device must be known and taken into account when positioning the muzzle of the barrel in the proximity of the target. The recoil can also be completely eliminated by anchoring the device to a heavy mass. Tests have indicated that for some applications the muzzle should be placed one projectile length from the target and the bore axis normal thereto (at right angles). In order to give support to the projectile while it is penetrating the target, a barrel extension, or false muzzle, may be used which may be placed nearly in contact with the target and can be replaced if damaged by premature projectile failure. The muzzle attachment may consist of a massive rubber cylinder or block (not shown) which could be traversed repeatedly by the projectiles without suffering permanent deformation. A hole of a sufficient diameter to permit free passage through the rubber may be provided which would act as a restraining member should the projectile experience any yaw.

Consideration must also be given to the possibility of barrel whip or vibrations. In long, flexible barrels the build up of internal pressure tends to straighten any curved portion. Additionally, passage of a long projectile tends to set up vibrations which could gain considerable amplitude at the muzzle. While the projectile is exiting, the muzzle can vibrate in a transverse motion thus imparting side thrust to the projectile. It is therefore necessary, in some but not all cases, to provide anchoring of the muzzle to prevent any lateral motion or to increase the mass so as to minimize the effects or delay them until the projectile has exited completely. The effect of muzzle disturbance is the more pronounced the longer the projectile and the slower its velocity.

At the high velocity regimes, the effect of muzzle disturbance on the effectiveness of the projectile is not as pronounced as at the lower velocities. Flight attitude of the projectile or the projectile column at impact influences its ability to successfully deliver its energy into a given target area or to fail by fracturing or through deformation by bending.

At hydrodynamic penetration velocity, forces set up during penetration are transmitted to the uncommitted parts of the projectile but preservation of exact symmetry and attitude are not as critical at these velocities because even damaged projectile elements are capable of contributing to the penetration.

Applicant has discovered that a kinetic energy of 30,000 ft. lbs is expended to generate one cubic inch perforation in steel armor of 370 Brinell by a projectile having a velocity of 3000 ft sec. striking the armor perpendicularly. The average compressive stress was discovered to be in the order of 400,000 lbs/in.$^2$.

ROCK PENETRATION AND EXCAVATION

In order to economically compete with existing methods of rock excavation and tunneling, the present invention is directed at vastly increasing the rate of penetration to compensate for its higher expendable costs.

For penetration and rubblizing rock, the major expendible cost items are the propellant cost and the projectile cost. It is, therefore, desirable to obtain the greatest transfer energy from the propellant material to the projectile and from the projectile to the rock target to achieve the greatest unit volume of rubblizing per unit of input energy, i.e., input cost.

The amount of energy transferred from the propellant to the projectile will be determined by the area of the projectile exposed to a given breach pressure and the time of exposure to that pressure. For small diameter projectiles, the barrel lengths of the launcher can be reduced, thus reducing the exposure time by increasing the area exposed to the breach pressure through the use of a light weight sabot or sheath 46 as shown in FIG. 5. As a practical economic limit, the energy time-pressure transfer is controlled or limited by the maximum breach pressure (about 45,000 psi) and barrel length of the launcher.

For two projectiles of equal mass and equal energy but one having an L/D of 4 with the other having an L/D of 6, it can be seen that the L/D of 6 projectile will have a smaller diameter and, therefore, will achieve a greater impact energy transfer per unit area to the rock than the L/D of 4 projectile and will, therefore, achieve greater depths of penetration. Also, since the surface area of the L/D of 6 projectile is less than the L/D of 4 projectile, the friction losses during penetration will be less.

In general, taking into account the reduction in friction losses, the ratio of projectile energy per unit of cross-sectional area, transfer efficiency of energy to a high L/D ratio projectile and the physical characteristics of rock as to its ratio of tensile to compressive strength, applicant has discovered that there is a marked increase in the overall efficiency of excavation for L/D ratios of about 6 or more.

The basic capability is that of achieving instantaneously penetrations of several feet of depth in rock. These penetrations can serve as bore holes to be loaded with explosives provided the projectile does not plug the penetration. This can be accomplished by use of projectiles as shown in FIGS. 6, 7, 8, 9 or 10 where only the forward element remains embedded in the penetration. The embodiment of FIG. 9 and combinations thereof with the other structures insures that all but the lead element, which is larger in diameter, remain loose in the penetration and can be withdrawn by magnets. In certain formations it has been found that the separate elements of FIG. 6, even though all of the same diameter, will create oversize holes due to slight shifting of the elements with respect to each other, thus eroding the penetration during their passage.

It has also been found that repetitious impacts in the vicinity of each other are capable of loosening the formation thus rubblizing it to permit its removal even without blasting.

In emergency conditions often encountered in mines, when rapid penetration of rock is the overriding consideration, subsequent projectiles may be fired into the remnants of the preceding ones.

When operating in the hydrodynamic penetration regime, it is sometimes possible to utilize projectiles made from softer materials, such as mild steel or the like. Under extreme conditions, such projectiles do not fail in the normal sense of the meaning but are consumed progressively during penetration. The extremely high impact pressures usually create a penetration of a larger diameter than the projectile itself.

It has proved advantageous under certain conditions, particularly in hard rock, to protect the nose of the projectile with a nosecap of less hard material as shown in FIG. 4. This member protects the point of the projectile during initial impact by exerting ring tension and by distributing the blow over a larger frontal area of the projectile.

Applicant has discovered that several modes of application of the penetrating system exist. The first one concerned with the creation of a borehole has already been discussed.

Another mode concerns rock penetration and simultaneous removal of rock. Since nearly all rock material in question fails under tension much more readily than under compression, the projectile is induced to describe a curved path in the target, as opposed to a straight line penetration. FIG. 20 illustrates the results applicant has achieved with either off center projectile points or impacts with symmetric projectile at angle of incidence. Failure of the rock occured along the projectile path and the line indicated on FIG. 20. Extensive rock removal by cratering and spalling was discovered, the volume of which exceeded the normal volume of a straight line perforation by 30 times. It is also possible to use a chisel shape to accomplish projectile deviation.

Thus simultaneous rock penetration and fracturing removal is possible with the device of the present invention when projectile impacts are directed at an optimum distance from a free rock face so that the rock is penetrated and at the same time moved toward the free face where it breaks up and off as rubble.

It should be noted that the projectiles can be recovered and with elements short enough, no damage may be experienced so that reuse is possible.

PROJECTILE DETAILS

As previously noted, it has been determined that certain formations respond to modifications of the nose shape. This is of particular importance when the projectiles are to be recovered after penetration and used repeatedly. A slightly rounded nose rather than an exceptionally sharp point is applicable in certain cases.

Successful penetration into hard rock requires that the projectile be hard to resist deformation and yet have the resilience to preclude fracturing. Since the impact stresses are the most severe at the nose portion and diminish rapidly toward the rear of the projectile, it is possible to decrease the hardness in the after portions. Where the gas check is made integral with the projectile, it is imperative that the rear portion of the projectile be relatively soft and ductile. This can be insured by gradient heat treating. Applicant has discovered that even hard projectiles penetrating substantial depth into granite or the like undergo noticeable abrasion. Nevertheless, repeated use is possible provided inspection for cracks is carried out before each use. The reduction in major diameter of the leading projectile must also be taken into consideration since in some applications it is desired to have a reduction in diameter in the second and following projectile elements. Reuse of the projectiles is usually only possible in the low and medium velocity regime. In the high velocity regime, in hard targets, the projectiles are usually stressed too highly or even consumed during penetration.

It must also be pointed out that the projectiles must have a specific gravity of its main member of at least 6 grams/cc. and a minimum hardness of 59 Rockwell C.

PROJECTILE PROPULSION SYSTEM

To avoid high circuit pressure and resulting costly oversizing or reinforcing of breech 20 and barrel 18, several methods of accelerating projectile 12 form a part of the present invention.

In FIG. 12 a booster charge 84 of propellant is accommodated in or adjacent to the main obturator in such a way that it moves with the projectile when the main propellant charge is generating gas pressure. This booster charge may be surface inhibited or partially inhibited to delay its activation until the projectile has moved to a position in the bore at which the gas pressure generated by the main charge has diminished below the desired minimum. The booster charge then again raises the pressure, increasing the acceleration.

In FIG. 11 the propellant booster charge 74 is located in the hollow projectile 52i and is activated by an impact or friction ignited mixture 77 located at the base of the projectile. With this arrangement, it is also useful under certain conditions to have some delay in the operation of booster charge 74. As the igniter mixture 77 flashes and activates the booster 74, gas pressure moving past the projectile is trapped by the protector or gas check 72 and begins to move the forward part of the column at a higher acceleration, thus causing a separation between the various elements and a velocity gradient within the column. The nose protector and gas check 72 positioned between the various projectile elements serves not only in the above functions in bore 24, but the nose protector 72 also assists each element during its initial contact with the target 14 (FIG. 1), improving its ability to withstand the severe initial stresses and even assisting it in penetrating the preceeding element if necessary.

In FIG. 13 a smaller projectile 12 is positioned in front of a large hollow projectile 88 containing a substantial propellant booster charge 86. When the main propellant charge 34 (not shown), located in the chamber 22c (not shown) is activated, its gases propel the entire column through the bore. When the assembly has reached a high velocity, the delay igniter 90 causes activation of the booster charge 86. The gas pressure drives the light, leading projectile 12 forward at higher acceleration rates while the following hollow projectile 88 continues to compress the booster charge 86 gases, thus insuring an increased mean pressure for this second launch. This results in quite a high velocity for leading projectile 12 without an excessively high breech pressure.

In FIG. 13a, ignition of propellant booster charge 86 is achieved by utilizing the hot gases from main propellant charge 34 (not shown) in the breech 20 (not shown) in conjunction with a heat conducting bulkhead 94. A heat sensitive material 96 such as potassium chlorate having a low ignition temperature is disposed against bulkhead 94 and in contact with booster charge 86.

The mass and thickness of heat conducting bulkhead 94 will determine the time delay for ignition of booster charge 96.

PROPELLANTS

A number of propellants may be used as the main charge. Smokeless powder in the proper granulation has been used extensively as well as propellants consisting of mixture of oxydizers, including nitrates, chlorates, perchlorates in combination with oxydizable materials such as carbon, oils, etc. Safety considerations require that the propellant be stable and exhibit controllable burning characteristics to preclude catastrophic pressure rises. The chemical properties of the propellant and its gases should be noncorrosive to the bore or at least controllable through cleaning and neutralization.

Impact or friction sensitive material 77 can be comprised of potassium chlorate and sugar and other self oxidizable materials.

Figure 19A:
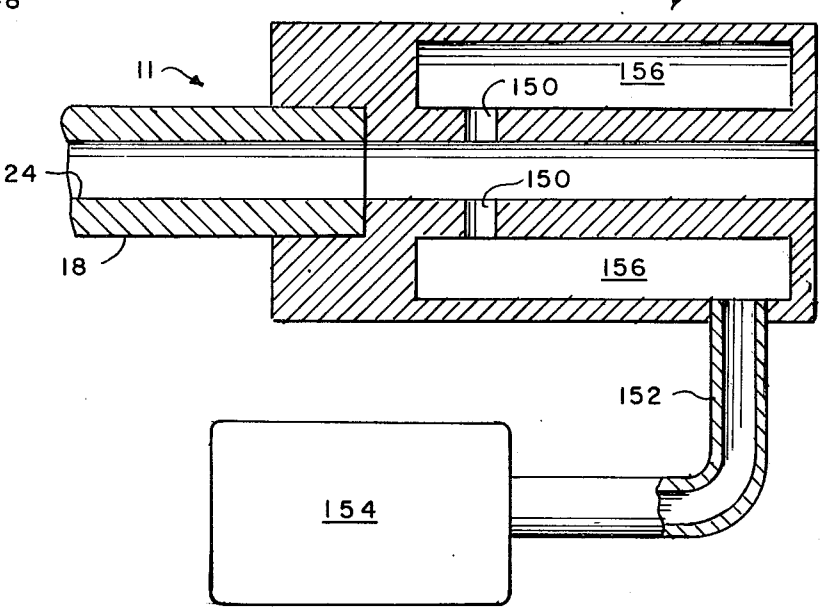
Figure 19:
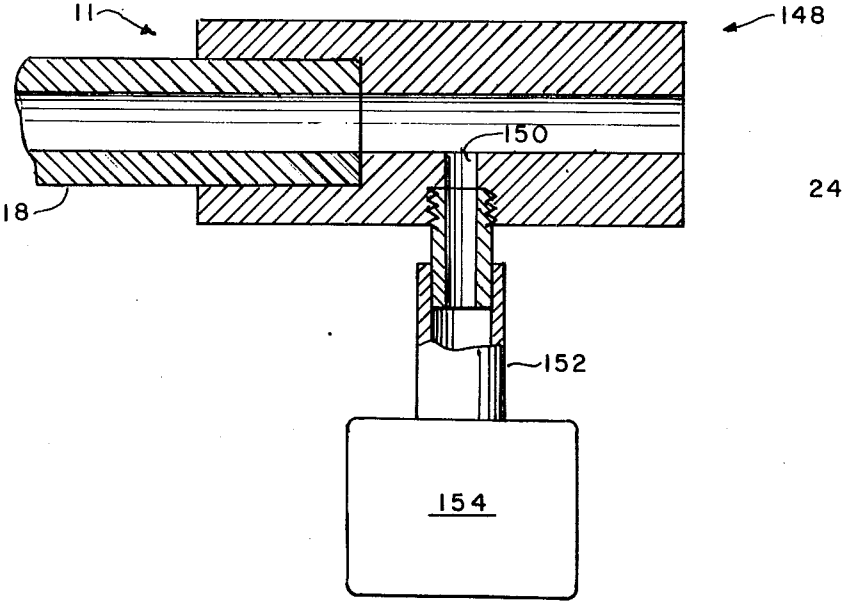

An important consideration in the use of the penetrator system under ground is the composition of the gases or fumes released and their potential toxicity. Carbon monoxide and nitrous oxides cannot be released into the atmosphere except in minimal amounts where there is a likelihood that they will be included by operating personnel. In FIGS. 19 and 19*a* are shown muzzle extensions 148 which may incorporate an exhaust port 150 leading to a suction hose 152 and vacuum pump 154. In FIG. 19a an expansion chamber 156 is shown which permits the gases to be safely trapped and withdrawn by suction hose 152. This expansion capability is important to improve the internal expansion ratio when large excesses of gas or poor fume properties are generated.

LOADING DENSITY AND SAFETY

It is possible with progressive burning propellants to achieve a reasonably high loading density in propellant chamber 22. At high loading densities, of 0.8 gram/cm$^3$, it is imperative that projectile motion and the volume increase resulting therefrom be closely controlled and dependable. If, for example, projectile 12 should encounter an obstruction in bore 24, particularly early in its travel, excessive pressure may result from this interference with progressive volume increase and damage resulting. Under certain conditions, it may be advisable to forego the advantages and efficiency of high loading density in favor of a lower propellant concentration in the order of 0.25 gram/cm$^3$ or even lower. At the suitable concentration, it is possible to completely burn the entire propellant charge 34 in the chamber without excess pressure, even though projectile 12 be blocked by an obstruction and immovable. During operations in confined space, where personnel must remain in close proximity of propellant chamber 22, this safety feature is important.

Another safety feature which may be used even at high loading densities is shown in FIG. 15. The propellant nearly fills chamber 34 necessitating precisely timed forward motion of projectile 12 to provide progressive expansion volume. Should anything interfere with normal functioning and the pressure build up beyond safe limits, shear flange 124 on obturator 120 will fail, freeing obturator 120 to move from its seal and hurled into safety plug 126. High pressure gas escapes through safety port 110 into retainer 114 and through conduit nipple 116 either into a large expansion chamber 112 or to a vacuum pump (not shown) or a combination of both. All connections must be designed to withstand pressures of the order of 40,000 psi or higher.

STATIC GAS SEALS

All connections between barrel sections 18*a* and 18*b* (FIGS. 16 and 17) extensions, chamber 22 attachment and breech section 20 require high pressure and high temperature resistant seals. FIG. 16 shows one method of sealing these joints comprising a metal compression seal 140 (FIG. 16), 142 (FIG. 17) and 144 (FIG. 18) and, additionally, an "O" ring seal 136 and 138. It should be noted that metal seals usually perform well at high pressures and temperatures but if failure does occur, the prolonged escape of hot gas erodes the contact surfaces causing extensive damage. It is therefore useful to position two or more seals in succession to minimize or prevent accidental gas escape. It should be noted that the movable gas obturator, shown in some of the embodiments behind the projectile and also in FIG. 15, can be used as a static seal in different forms. Since its sealing characteristics are based on the ability of the tapering walls to expand under high internal pressure, this type seal performs well while the pressures are adequate to achieve expansion but at low pressures, gas bypass may take place. For this reason, an additional seal is normally provided to trap gases which may bypass the primary seal. FIG. 17 shows a thin metal seal 142 positioned in a matching groove. As the gas is forced against it, intimate metal to metal contact is established and gas escape is precluded. FIG. 18 shows a triangular wedge ring seal 144 which is put under initial compression when the parts are secured together by threads 130, 132 and 134. Internal gas pressure, of course, increases the intimacy of the contact the higher the pressure.

I claim:

1. An apparatus for fracturing rock comprising 'a projectile launcher having a muzzle portion, a barrel portion with means defining a smooth internal bore, and a breech portion, a projectile adapted to fit into said bore and be propelled from said launcher comprising a nose cap portion disposed proximate the front end of said projectile and fabricated from a light weight, ductile material, an obturator portion disposed proximate the trailing end of said projectile, a body sleeve portion fabricated from a ductile material disposed between said nose cap portion and said obturator portion, a core body disposed in said body sleeve portion, said core body having a length to diameter ratio greater than 6 to 1 with a minimum hardness of 59 Rockwell C and a density greater than 6 grams/cc, and means disposed behind said obturator for propelling said projectile from said launcher.

2. The apparatus as claimed in claim 1 wherein said core body comprises a nose portion and a body portion, said nose portion having a diameter greater than said body portion.

3. The apparatus as claimed in claim 1 wherein the outside diameter of said nose cap and obturator portion are equal to the inside diameter of said bore, and the outside diameter of said body sleeve portion is less than the inside diameter of said bore.

4. The apparatus as claimed in claim 1 wherein said obturator portion further comprises an obturator gas seal fin portion, an obturator body portion disposed in front of said gas seal fin portion, means defining a cavity disposed in the leading end of said obturator portion, an oxidizable gas generating material disposed in said cavity, and means for igniting said oxidizable gas generating material comprising, a frictionally ignitable material disposed between the leading end of said obturator portion and the trailing end of said core body, and said frictionally ignitable material in frictional contact with said oxidizable gas generating material.

5. The apparatus as claimed in claim 1 wherein said core body comprises a plurality of serially disposed individual core body members encased in said body sleeve portion.

6. The apparatus as claimed in claim 5 wherein the leading core body member has a diameter greater than the diameter of the core body members following.

7. An apparatus for fracturing rock comprising a projectile launcher having a muzzle portion, a barrel portion with means defining a smooth internal bore, and a breech portion, a projectile adapted to be propelled from said launcher, said projectile having a length to diameter ratio of 6 to 1, and comprising a nose section disposed proximate the front end of said projectile, an obturator portion disposed proximate the trailing end of said projectile and comprising an obturator gas seal fin portion, an obturator body portion in front of said gas seal portion, means defining a cavity disposed in the leading end of said obturator body portion, an oxidizable gas generating material disposed in said cavity, and means for igniting said oxidizable gas generating material comprising a frictionally ignitable material disposed between the leading end of said obturator body portion and the trailing end of said projectile, said frictionally ignitable material in frictional contact with the bore of said launcher barrel and in ignitable contact with said oxidizable gas generating material, the diameters of said nose portion and said obturator portion being equal to the inside diameter of said bore, said barrel portion being longer than said projectile, and means for propelling said projectile from said launcher.

8. An apparatus for fracturing rock comprising a projectile launcher having a muzzle portion, a barrel portion having a smooth internal bore, and a breech portion, a projectile adapted to be propelled from said launcher, said projectile having a length to diameter ratio greater than 6 to 1 comprising a nose portion proximate the front end of said projectile, an obturator portion disposed proximate the trailing end of said projectile, a plurality of individual core body projectile members serially disposed between said nose portion and said obturator portion, each individual core body member comprising a nose portion, a tail portion, a body portion having means defining a longitudinal cavity therein extending from said nose portion to said tail portion, and means for propelling said core body members disposed in said cavity comprising an oxidizable gas generating material disposed in said cavity, and a frictionally ignitable material disposed between said individual core body members in frictional contact with the inside surface of said launcher bore and in ignitable contact with said oxidizable gas generating material, means for connecting said nose, obturator and individual core body members to each other, said barrel portion being longer than said projectile, and means for propelling said projectile from said launcher.

* * * * *